United States Patent [19]

Perrine

[11] Patent Number: 4,719,841

[45] Date of Patent: Jan. 19, 1988

[54] TRIGGER RELEASE MECHANISMS FOR FULL AND SEMI AUTOMATIC OPEN BOLT WEAPONS

[76] Inventor: Walter E. Perrine, 12356 Addison St., N. Hollywood, Calif. 91607

[21] Appl. No.: 897,634

[22] Filed: Aug. 18, 1986

[51] Int. Cl.[4] ..... F41D 3/02

[52] U.S. Cl. ..... 89/189; 42/70.04; 89/1.4; 89/144; 89/148

[58] Field of Search ..... 42/70.04, 70.05, 70.06; 89/1.4, 132, 139, 142, 144, 148, 168, 175, 189

[56] References Cited

U.S. PATENT DOCUMENTS

| | | | |
|---|---|---|---|
| 1,897,710 | 2/1933 | Pelo | 89/175 |
| 3,630,119 | 12/1971 | Perrine | 89/189 |
| 3,661,049 | 5/1972 | Perrine | 89/189 |
| 3,709,091 | 1/1973 | Perrine | 89/189 |
| 3,732,779 | 5/1973 | Perrine | 89/189 |
| 3,748,961 | 7/1973 | Perrine | 89/189 |
| 3,783,739 | 1/1974 | Perrine | 89/189 |
| 4,126,079 | 11/1978 | Perrine | 89/190 |
| 4,183,282 | 1/1980 | Perrine | 89/189 |
| 4,467,698 | 8/1984 | Perrine | 89/190 |

FOREIGN PATENT DOCUMENTS 664737 1/1952 United Kingdom ..... 42/70.06

*Primary Examiner*—Stephen C. Bentley

*Attorney, Agent, or Firm*—Warren F. B. Lindsley

[57] ABSTRACT

A hesitation blowback toggle action weapon in which an under-center toggle employing interconnected toggle links recedes and redirects the recoil energy directed against the face of the bolt generated at the time of firing into the handle of the weapon, and in so doing either:

1. Avoids the full auto sear as long as the trigger is pressured so that movement of the bolt and linkage of the weapon will continue until the ammunition of the magazine is spent, or
2. Engages a semi automatic sear pivotally associated with the trigger of the weapon to lock the weapon in toggle collapsed position until the trigger is sequentially released to unseat sear from the trigger, and then again pressured to release the sear from the toggle mechanism, thus firing another single round.

7 Claims, 17 Drawing Figures

49
48
26
28
29
11'
25
24
25A
22
23
25B
54
44
19
42
12
10A
50
43
40
46
14A
47
41
45
17
16
79
10B
10'
10
11
13
14B

TRIGGER RELEASE MECHANISMS FOR FULL AND SEMI AUTOMATIC OPEN BOLT WEAPONS

BACKGROUND OF THE INVENTION

This invention relates to full and semi automatic open bolt firing weapons, and more particularly to new and improved trigger release trip mechanisms for hand held rifles and pistols.

DESCRIPTION OF THE PRIOR ART

Heretofore, the majority of all weapons of this class have been toggle actuated causing their toggle links to recede into the handle of the gun when fired to offset the effects of firing recoil and are biased toward their locked position by means of a spring bearing in a given area on the toggle.

Applicant's U.S. Pat. Nos. 3,630,119; 3,661,049; 3,709,091; 3,732,779; 3,748,961; 3,783,739; 4,126,079; 4,183,282 and 4,467,698 are the closest prior art known, but differ from the invention claimed herein.

SUMMARY OF THE INVENTION

In accordance with the invention claimed, a new and improved mechanism is disclosed employing a novel trigger release mechanism which cooperates with a particular toggle linkage configuration, which toggle mechanism effectively absorbs and redirects the effects of the shell explosive forces in weapons such as rifles and pistols.

It is, therefore, one object of this invention to provide a new and improved hand held weapon in which shell explosive forces cause the bolt controlled toggle mechanism to recede to a retracted position in the handle of the weapon thereby redirecting recoil forces to the lower handle.

Another object of this invention is to provide a new and improved trigger sear mechanism which cooperates with the bolt-toggle mechanism to lock or release the toggle for a fully automatic firing weapon.

A further object of this invention is to provide a modification of the above trigger sear mechanism which cooperates with the bolt-toggle mechanism to lock the gun in a cocked position each time it is to be fired when a semi automatic firing weapon is desired.

A still further object of this invention is to provide an improved weapon employing a bolt-toggle mechanism, a rear link of which is contoured to the rear handle frame around which it pivots while also contoured to cooperate with the trigger sear to lock the weapon in an open bolt firing position.

A still further object of this invention is to provide an improved weapon employing a lever attached to a bolt that is cam assisted which operates against the frame of the weapon to initiate manual cocking of the bolt.

A still further object of this invention is to provide an improved weapon employing a trigger safety consisting of a stepped pin placed between the trigger and the sear, whereby when disengaged with the smaller diameter of the pin in use, both trigger and sear have freedom of movement, and when engaged with the larger diameter of the pin in use, both trigger and sear are positively locked and unable to move.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
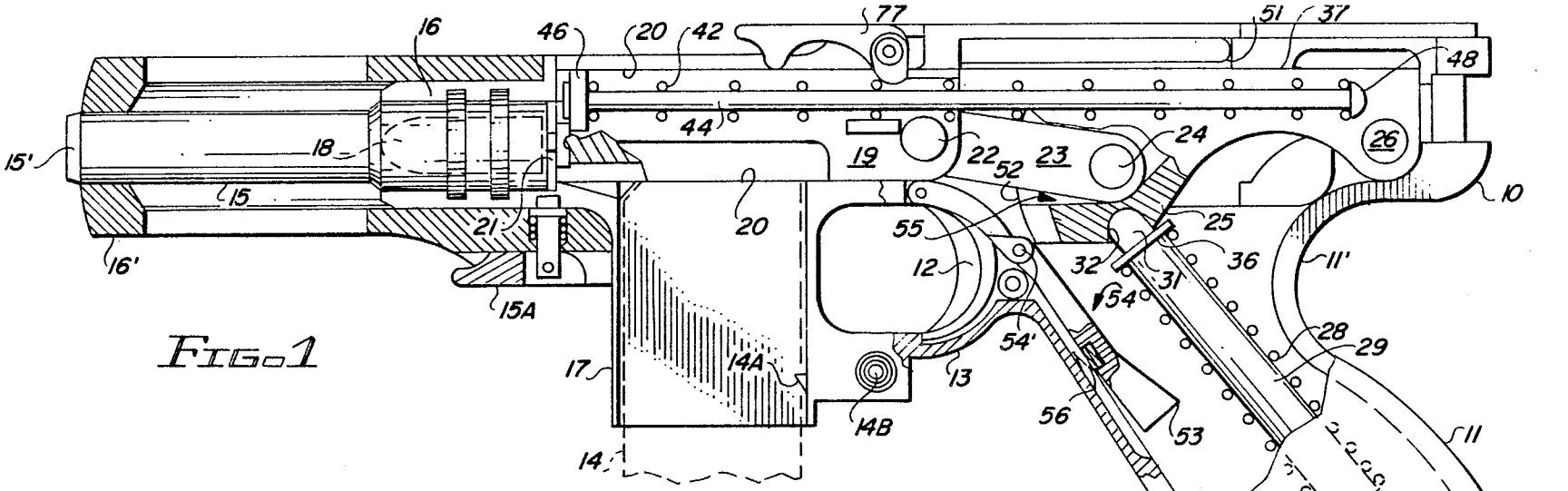
FIG. 1 is a partial cross-sectional view of a hesitation blowback weapon incorporating the features of this invention.

Referring more particularly to the drawings by characters of reference, FIGS. 1–4 illustrate a hand held weapon such as a pistol having a frame 10 comprising two interconnectable parts 10A and 10B, which pivot on pin 10' in a clam shell action, with part 10A being the major frame, and part 10B being the minor frame, a handle section 11, a trigger 12, a trigger guard section 13, and a cartridge magazine 14. A detachable barrel 15 is mounted in the shroud section 16 of the front end of frame 10, and locked in place by shroud 16'. Shroud 16' is itself retained by a known spring biased pin means 15A which is pivotally moved into and out of shroud 16' retaining position.

Figure 2:
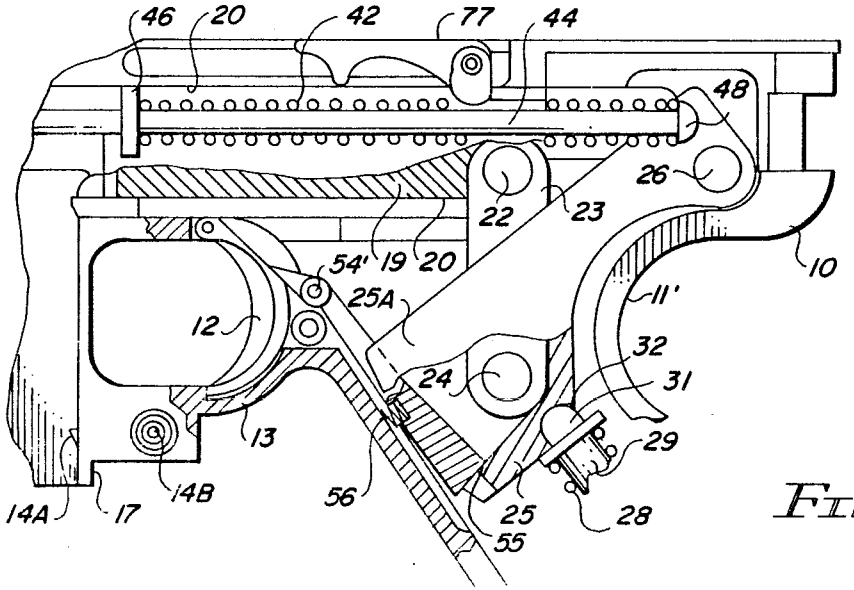
FIG. 2 is a view similar to FIG. 1 showing the rear link of the bolt controlled toggle mechanism locked with the sear in a ready to fire position.
Figure 5:
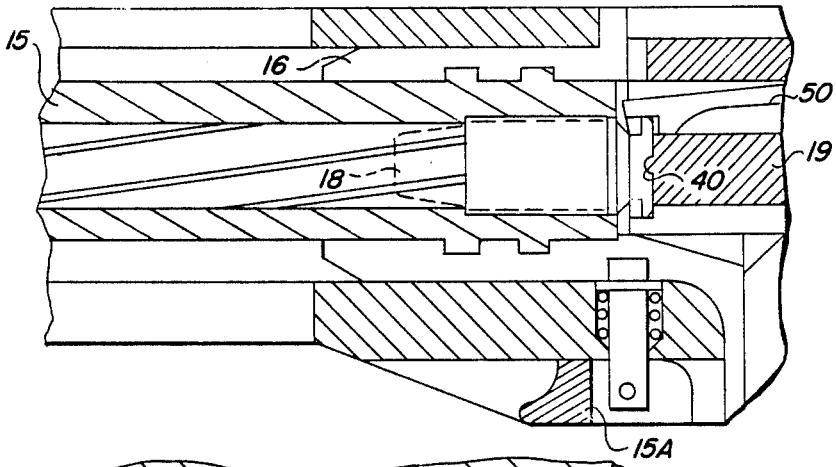
FIG. 5 is a partial cross-sectional view of the left end of the weapon shown in FIG. 1 detailing the barrel shroud retaining pin in the engaged position.
Figure 6:
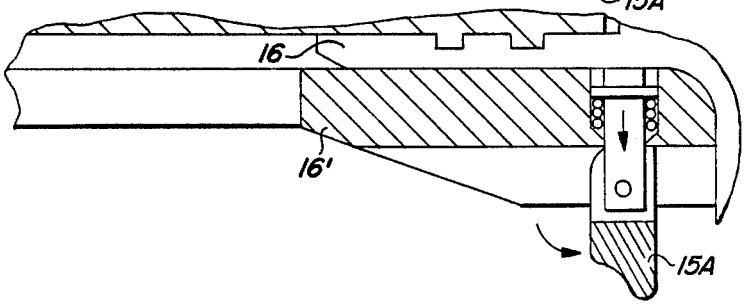
FIG. 6 is a partial view of FIG. 5 showing the barrel shroud retaining pin in the disengaged position.
Figure 7:
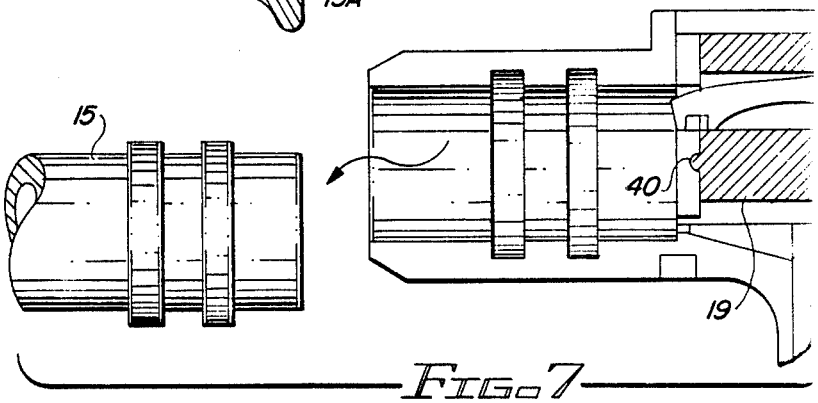
FIG. 7 is a partial view of FIG. 5 showing a portion of the barrel removed from the shroud section of the frame which envelopes the breech end of the barrel.
Figure 8:
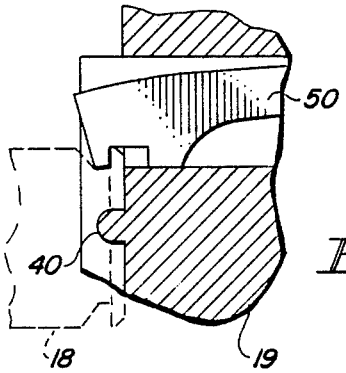
FIG. 8 is a partial view of the weapon shown in FIG. 1 illustrating the cartridge positioning and retraction mechanism.

The demountable magazine 14 is released by magazine release button 14B and is secured by a releasable latch 14A shown in FIGS. 1 and 2 in a guide sleeve 17 of frame 10 to feed cartridge 18 shown in FIGS. 1 and 5 into insertion and firing position by a bolt 19 which moves on upper and lower guiding surfaces 20 in frame 10 to the breech 21 of barrel 15. The rear end of bolt 19 is pivotally connected by a pivot pin 22 carried in the front end of a forward link 23, the rear end of which is pivotally connected by a pivot pin 24 to the front end of a rear link 25. The rear link is in turn pivotally connected by a pivot pin 26 carried in the rear portion of frame 10A to thus provide a toggle 23–25 for controlling the movement of bolt 19.

Normally, when a cartridge 18 has been loaded in the barrel 15 in firing position and fired, toggle 23–25 is substantially aligned, as shown in FIG. 1, at which time the axis of pin 24 is slightly below a line between the axis of pin 22 and 26 so that the toggle 23–25 is in an under-center locked position. A compression spring 28 is carried on a push rod comprising two telescopic parts 29 and 30 which are slidably supported in handle section 11 with end 31 of part 29 pivotally interconnected with an aperture 32 in rear link 25. The compression spring 28 is operatively positioned between an aperture 34 in the base of handle section 11 into which an end 35 of part 30 is positioned and a flange 36 of part 29 of the push rod is positioned to hold toggle 23–25 in a normally yielding position against flat surface 37 which comprises the under-center locked position of the toggle at firing.

The under-centered locked position of toggle 23–25 is broken by the rearward motion of bolt 19 caused by gas pressure against the inside rear of the cartridge case when the cartridge is fired, which pressure initiates the action termed hesitation blowback. As used herein, hesitation means that the toggle linkage delays the bolt's travel, and blowback means that the bolt is sent rearward independent of the barrel and only by the pressure upon the bolt from the rearward moving spent case.

Figures 3, 4:
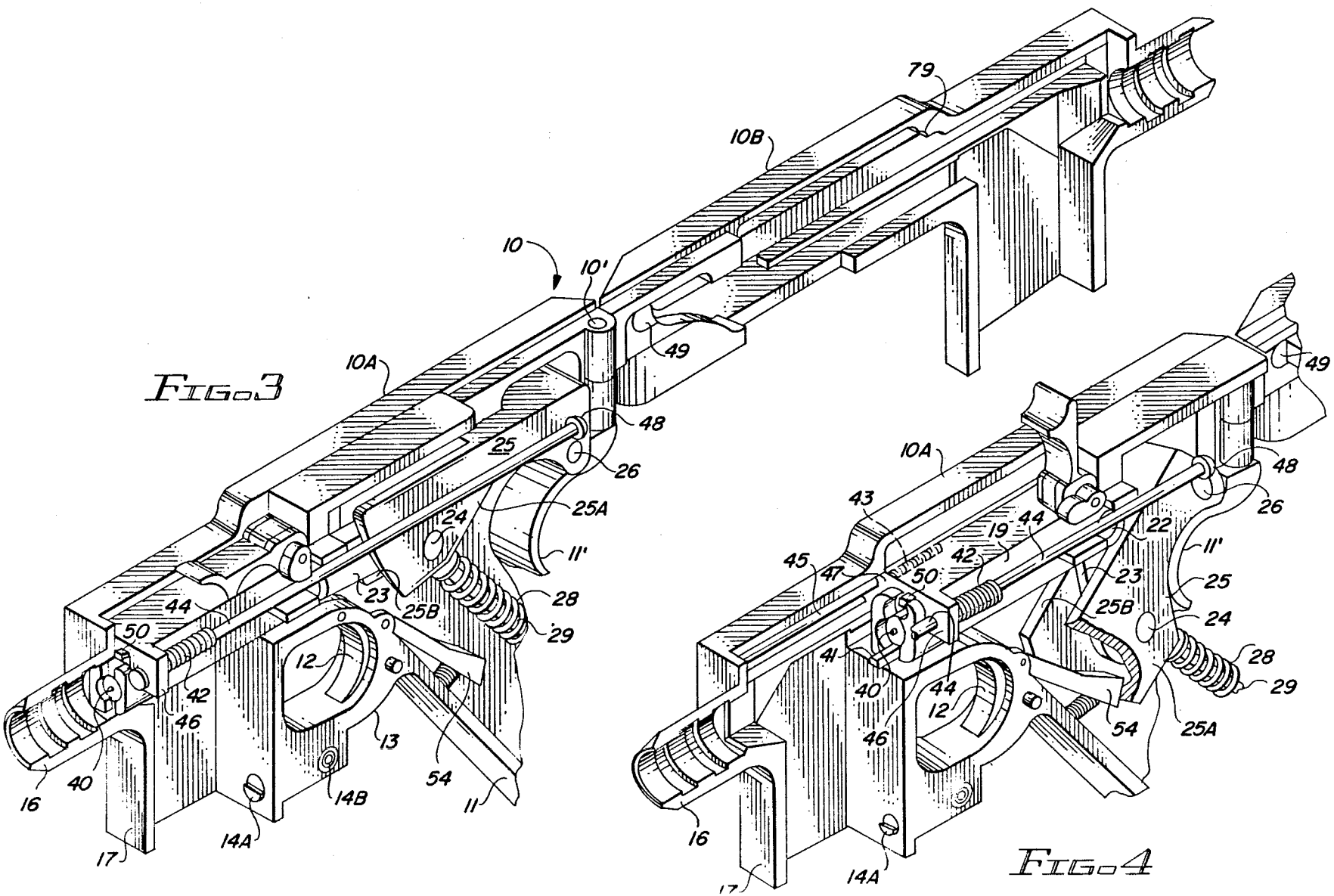
FIG. 3 is a pictorial view of the weapon shown in FIG. 1 with the minor frame shown pivoted 180 degrees from its engaging position with the major frame housing the bolt-toggle mechanism.
FIG. 4 is a partial pictorial view of the weapon shown in FIG. 3 with the rear link of the toggle mechanism in engagement with the sear.

As noted from FIGS. 1, 2, 3 and 4 of the drawings, bolt 19 comprises a normal rectangular configuration with radius on the bottom portion, a flat rectangular surface on its top which is guided by upper and lower surfaces 20 which form part of the inside periphery of frame 10 of the weapon. The firing pin 40 of bolt 19 is fixed as seen in FIGS. 3 and 4, and activates the primer of the cartridge by forceful contact when the bolt is released from the open bolt position.

As shown in the drawings of the prior art, as exemplified by applicant's U.S. Pat. Nos. 3,630,119 and 4,126,079, which are included herein by reference, a pair of compression springs 42 and 43 disclosed herein have been arranged on rods 44 and 45, each provided with rear rod heads 48. Each rod is parallelly arranged one on each side of bolt 19 between lugs 46 and 47 of bolt 19 and bore holes 49 defined by frame 10A and 10B of the weapon.

At the time cartridge 18 of this application is fired, and the bullet leaves the barrel and is on its way to its target, the rearward pressures on bolt 19 will drive bolt 19 and extractor 50, which is attached to the bolt and the spent cartridge case held by the extractor, backwards until the empty case hits the ejector 41 on frame 10A and is thrown from the weapon. Bolt 19 as seen in FIGS. 1 and 2, is moving backwards with sufficient force to complete the travel of its toggle mechanism sufficiently to move the center pin 24 of the toggle, and force it to complete its downward travel to its lowest point inside the handle of the gun against the bias of compression springs 42, 43 and 28, shown in FIGS. 3 and 4.

The inertia of the rearward action of bolt 19 compresses the recoil compression springs 42 and 43 as well as spring 28 until the end of the bolt engages a stop surface 51 of the frame of the weapon. At this time, surface 55 of link 25 is engaged and held in locked position by surface 53 of sear 54. Sear 54 comprises an elongated member pivotally mounted at one end to frame 10 to lie within and longitudinally of handle section 11. The weapon is now in the open bolt ready to fire position.

Upon release of sear 54 to initiate full automatic fire, bolt 19 and toggle 23–25 are then returned to their forward position by the stored up energy in the three springs, 42, 43 and 28, picking up a cartridge from the magazine, placing it in the firing chamber at the rear of barrel 15, and detonating it upon the impact of the firing pin 40 fixed in the face of bolt 19. This completes the firing cycle.

As noted from FIGS. 1–4 of the drawings, link 25 comprises a bifurcated configuration forming a pair of coplanar spaced members 25A and 25B between which sear 54 of the trigger mechanism is received during the cocking operation of the weapon. A ledge 55 on and between members 25A and 25B engages sear 54 to rotate its lower end shown in FIGS. 1, 2, 4, 9 and 10 about its pivot 54' and against the biasing effect of its spring 56. This action allows the ledge 55 of the rear link 25 to pass below surface 53 of the sear which then allows the biasing effect of spring 56 on sear 54 to firmly engage surface 55 of link 25 with surface 53 to hold link 25 in its position shown in FIG. 2 against the biasing effect of springs 42, 43 and 28.

Figure 10:
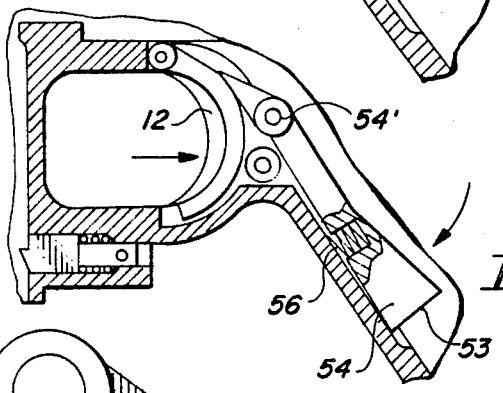
FIG. 10 is a view similar to FIG. 9 showing the fully automatic trigger sear mechanism in a firing position disengaged from the rear link of the toggle of the weapon.

In order to discharge the weapon, finger pressure on trigger 12 causes counterclockwise movement thereof, as shown in FIG. 10, to rotate sear 54 clockwise which action releases link 25 causing springs 28, 42 and 43 to force linkage 23–25 to move towards its slightly under-center position. This action causes bolt 19, with fixed firing pin 40, to pick up a cartridge from the magazine and to move the cartridge to the breech of barrel 15 and to impact the firing pin against the primer of cartridge 18 to explode it. If pressure against trigger 12 is maintained, the weapon will continue to fire fully automatic until magazine 14 is empty.

Figure 11:
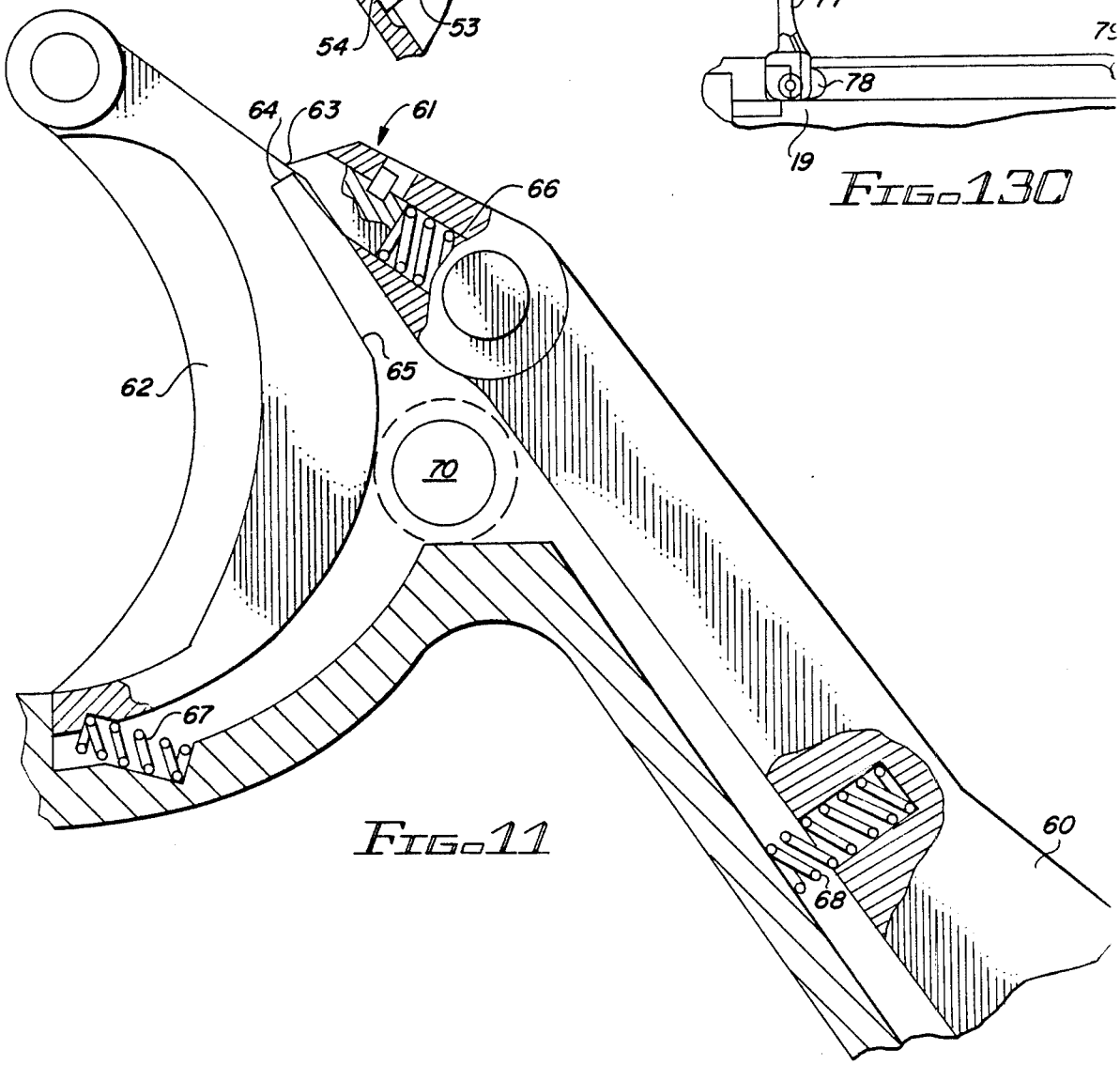
FIG. 11 is an enlarged view of the semi automatic trigger sear mechanism which is a modification of the trigger sear mechanism of FIGS. 1 and 2 shown prior to release from the rear link of the toggle.

FIG. 11 discloses the semi automatic trigger sear mechanism which is a modification of the fully automatic mechanism shown in FIGS. 1–4, 9 and 10, wherein the sear 60 comprises a trip 61 for trigger 62 with a trip point 63 which interlocks with a ledge 64 formed by seat 65 of the trigger. Trip 61 has mounted in its tip, the spring biased trip point 63 which engages and interlocks with the edge of the trigger ledge 64.

As shown in FIG. 11, the semi automatic trigger mechanism is ready to fire. Trigger 62 is in its forward position. When the trigger is pulled to the rear of the weapon far enough, trip 61 will rotate clockwise, thereby causing the lower section of sear 60 to move clockwise against bias of spring 68 and disengage ledge 55 of the rear link 25 of the toggle mechanism, allowing bolt 19 to move forward to fire. The further clockwise rotation of the sear releases the trip point 63 of the sear trip 61 from its interlocking contact with ledge 64 of trigger 62, causing trip point 63 to fall within trigger seat 65 and against trigger ledge 64, thereby causing the lower section of sear 60 to rotate counterclockwise and again engage ledge 55 of rear link 25 of toggle 23–25.

It is now necessary for the operator to release pressure against the trigger and the bias of spring 67 to reset the sear over ledge 64 on the peripheral edge of the trigger for the next firing action to take place. Spring 66 of trip 61 allows the trip point to back up when the trigger is released so that the trigger can return to a position where the trip point is in engagement with ledge 64, thus requiring a further trigger action to again fire the weapon, thus rendering the weapon semi automatic.

Figure 12A:
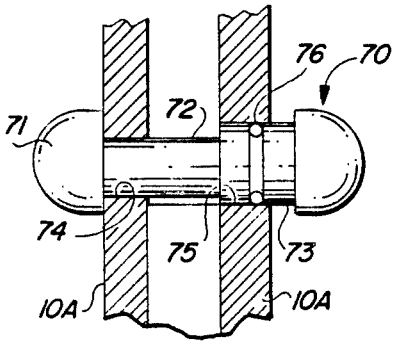
FIGS. 12A–12C are enlarged views of the stepped pin safety positioned between and acting upon both trigger and sear.
Figure 12B:
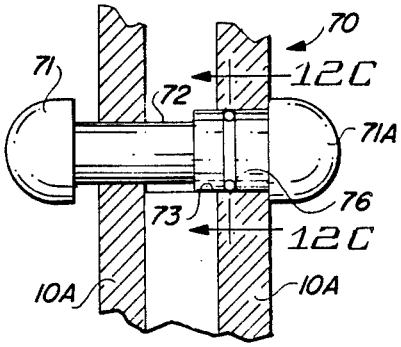
Figure 12C:
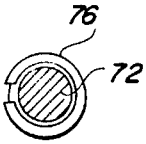
Figure 9:
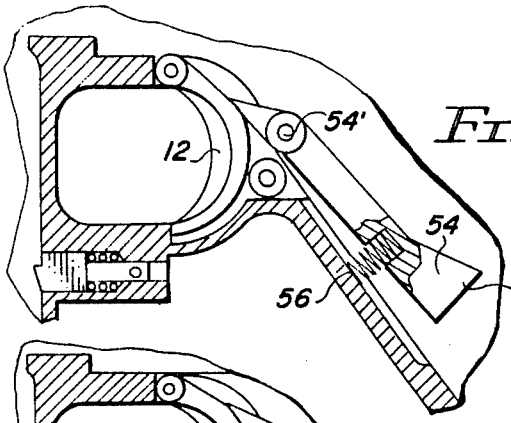
FIG. 9 is an enlarged view of the fully automatic trigger sear mechanism of FIG. 1 shown in a nonfiring locked position and positioned for engaging with the rear link of the toggle of the weapon.

FIGS. 12A–12C disclose a trigger safety 70 which comprises a stepped pin 71 having a small diameter portion 72 and a larger diameter portion 73 held in frictional engagement in bores 74 and 75 in frame 10A by a spring biased ring 76.

As shown in FIG. 11, the trigger safety 70 is mounted on the frame 10 of the weapon between the trigger 62 and sear 60, such that when the small diameter of the pin is exposed as shown in FIG. 12A, both trigger 62 and sear 60 have freedom of movement. When the safety is moved axially to the position shown in FIG. 12B by pushing axially inwardly on knob 71A of the pin 71, the larger diameter 73 of the pin is exposed between the parts of the frame and the trigger and sear are then positively locked against movement.

For both full and semi automatic fire, the forward movement of bolt 19 is sequentially reversed after firing by the well known explosive forces of the cartridge as mentioned above, which reverse movement compresses springs 42, 43 and 28.

As evident from FIGS. 2 and 4, bolt 19 moves backwardly in frame 10 under the explosive forces of the cartridge toward the rear end thereof. The engaging ends of links 23 and 25 are then moved into handle section 11 of the frame, acting upon spring 28 and rod 29–30, which absorb and redirect the reactive forces of the exploding cartridge.

Heretofore, in weapons of blowback design, the toggle mechanism acted as a locking device and when collapsed, the recoil forces had to be absorbed by the bolt, and when it struck an abutting surface at the rear of the weapon, the bolt transmitted the recoil of the exploding cartridge to the holder of the weapon. In accordance with the invention claimed, a braking system for the bolt is provided which is effective without adding undesirable weight to the moving recoil control system found necessary in the prior art.

This braking system provided by the toggle linkage 23–25 becomes progressively less effective as the toggle collapses and spring 28 compresses and thus directs the unabsorbed energy to aperture 34 of section 11 of the frame via rod 29–30. This redirected energy to aperture 34 causes a downward motion of the muzzle 15' upon firing due to the pivot action of frame section 11' against the web of the hand of the pistol operator. This downward motion of the muzzle 15' is counterbalanced by the upward motion of the muzzle 15' due to gas release from muzzle 15' after firing and bolt 19 and springs 43 and 44 acting rearward above the operator's hand, thus producing a level firing weapon with less felt recoil.

Figure 13A:
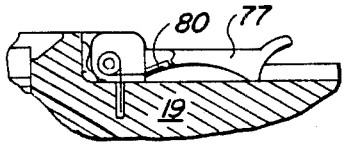
FIGS. 13A–13C illustrate diagramatically the cam assisted cocking lever needed when manually breaking the locked position of the toggle for retracting the bolt into the open bolt position which is the ready position for feeding and firing of a cartridge.
Figure 13B:
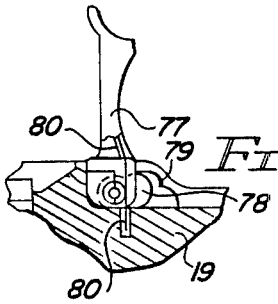
Figure 13C:
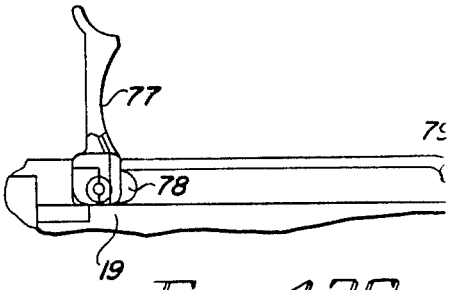

In order to cock the weapon and bring the bolt into the ready to fire open bolt position with the sear 54 engaging the rear link 25, a manual lever 77, as shown in FIGS. 1–4 and 13A–13C, is pivotally mounted on the bolt so that when pivoted against its spring 80 bias to the position shown in FIG. 13B by the operator, it causes its cam surface 78 to engage a point 79 on frame 10B of the weapon, thereby causing link 23 to move downwardly enough to break the toggle lock of 23–25, whereby the operator can easily complete the rearward positioning of bolt 19, as shown in FIGS. 4 and 13C.

Although but a few embodiments of the invention have been shown and claimed, it will be apparent to those skilled in the art that various changes and modifications may be made therein without departing from the spirit of the invention or from the scope of the appended claims.

What is claimed is:

1. A hesitation blowback bolt action weapon comprising:

a frame, a handle on said frame, a trigger mounted on said frame adjacent said handle, a hollow barrel having a firing chamber, a bolt movable in said frame axially to and from the firing chamber of said barrel, a toggle interconnected between the bolt and the frame, said toggle comprising a pair of pivotally connected links, the free end of one of said links being pivotally connected to said frame and the free end of the other of said links being pivotally connected to said bolt, the end of said one of said links at said pivotal connection comprising a bifurcated configuration, said toggle being movable to an under-center locked position slightly below a line between the pivotal connection of the toggle on the frame and on the bolt, said pivotal interconnection of said links of the toggle swinging said toggle downwardly within the handle of the weapon upon firing of the weapon, said one of said links of said toggle directing recoil forces to lower rear end of said handle of the weapon, a sear pivotally mounted within said handle and within the path of movement of said toggle into said handle, said sear engaging said one of said links of said toggle adjacent the point of their pivotal connection within said bifurcated configuration upon movement of said toggle into said handle to lock said toggle in its collapsed position until released by finger pressure applied to said trigger which pressure causes said sear to rotate out of engagement with said toggle, and a spring mounted within said handle between said handle and said sear for biasing said sear in counterclockwise direction to its movement by said trigger for aiding in locking said toggle in collapsed position.

2. The hesitation blowback bolt action weapon set forth in claim 1 wherein:

said sear comprises an elongated member pivotally mounted to extend within and along the length of said handle in contact with said one of said links which when engaged by said trigger, pivots clockwise causing it to disengage from said one of said links and remain clear from said one of said links so that the weapon can continue to fire fully automatic until the operator of the weapon releases pressure on the trigger, whereby release of the trigger causes said sear to rotate counterclockwise into engagement with said one of said links to stop the repeating toggle action of the weapon.

3. The hesitation blowback bolt action weapon set forth in claim 1 wherein:

said sear comprises an elongated member pivotally mounted to extend within and along the length of said handle in contact with said one of said links which when engaged by a counterclockwise moving trigger, pivots clockwise a first predetermined distance, causing it to disengage from said one of said links and causing the forward movement of the bolt and the firing of a single cartridge in the weapon, said trigger being provided with an indented seat, whereby upon a further counterclockwise movement of said trigger causes a counterclockwise movement of said sear after engagement with said seat of said trigger, said trigger causing said sear to again engage said one of said links and sequential release of pressure on said trigger causes said trigger to return to its original position and said sear to align itself with said trigger.

4. The hesitation blowback bolt action weapon set forth in claim 1 wherein:

said bifurcated configuration comprises a pair of coplanar spaced members and a ledge formed between said coplanar spaced members, and said sear engaging said ledge upon movement of said toggle into said handle to lock said toggle in its collapsed position.

5. A hesitation blowback bolt action weapon comprising:

a frame, a handle on said frame, a trigger mounted on said frame adjacent said handle, a hollow barrel having a firing chamber, a bolt movable in said frame axially to and from the firing chamber of said barrel, a toggle interconnected between the bolt and the frame, said toggle comprising a pair of pivotally connected links, the free end of one of said links being pivotally connected to said frame and the free end of the other of said links being pivotally connected to said bolt, said toggle being movable to an under-center locked position slightly below a line between the pivotal connection of the toggle on the frame and on the bolt, said pivotal interconnection of said links of the toggle swinging said toggle downwardly within the handle of the weapon upon firing of the weapon, said one of said links of said toggle directing recoil forces to lower rear end of said handle of the weapon, a sear pivotally mounted within said handle and within the path of movement of said toggle into said handle, said sear engaging said one of the links of said toggle adjacent the point of their pivotal connection, a spring mounted within said handle between said handle and said sear for biasing said sear in counterclockwise direction to its movement by said trigger for aiding in locking said toggle in collapsed position, said toggle upon movement into said handle engaging said sear to lock said toggle in its collapsed position until released by finger pressure applied to said trigger which pressure causes said sear to rotate out of engagement with said toggle, and a lever pivotally mounted on said bolt and extending outwardly of said frame, said lever having a cam surface for engaging said frame upon pivotal movement thereof to actuate said bolt rearward of said weapon to cause partial collapse of said toggle to cause said bolt to be extended rearwardly thereof to an open bolt position with said one link engaging said sear.

6. The hesitation blowback bolt action weapon set forth in claim 5 wherein:

said lever is spring biased into a position substantially horizontal with the longitudinal axis of said frame and is rotated laterally of said frame for manually moving said bolt.

7. A hesitation blowback bolt action weapon comprising:

a frame, a handle on said frame, a trigger mounted on said frame adjacent said handle, a hollow barrel having a firing chamber, a bolt movable in said frame axially to and from the firing chamber of said barrel, a toggle interconnected between the bolt and the frame, said toggle comprising a pair of pivotally connected links, the free end of one of said links being pivotally connected to said frame and the free end of the other of said links being pivotally connected to said bolt, said toggle being movable to an under-center locked position slightly below a line between the pivotal connection of the toggle on the frame and on the bolt, said pivotal interconnection of said links of the toggle swinging said toggle downwardly within the handle of the weapon upon firing of the weapon, said one of said links of said toggle directing recoil forces to lower rear end of said handle of the weapon, a sear pivotally mounted within said handle and within the path of movement of said toggle into said handle, said sear engaging said one of the links of said toggle adjacent the point of their pivotal connection, a spring mounted within said handle between said handle and said sear for biasing said sear in counterclockwise direction to its movement by said trigger for aiding in locking said toggle in collapsed position, said toggle upon movement into said handle engaging said sear to lock said toggle in its collapsed position until released by finger pressure applied to said trigger which pressure causes said sear to rotate out of engagement with said toggle, a longitudinally movable two diameter pin joined in bearing holes in said frame between said trigger and said sear whereby when moved to position one diameter of said pin between said trigger and sear, both trigger and sear have freedom of movement, and when moved to position the other diameter of said pin between said trigger and sear both trigger and sear are locked and unable to move, thereby providing a safety mechanism against inadvertant firing of the weapon, and a circular spring mounted around said other diameter in one of said bearing holes for maintaining said pin in said frame.

* * * * *